United States Patent [19]

Rundo

[11] Patent Number: 4,825,609

[45] Date of Patent: May 2, 1989

[54] WINDOW MOLDING

[75] Inventor: John R. Rundo, Strongsville, Ohio

[73] Assignee: The BF Goodrich Company, Akron, Ohio

[21] Appl. No.: 236,886

[22] Filed: Aug. 26, 1988

[51] Int. Cl.[4] ..... E06B 3/64; E06B 3/58

[52] U.S. Cl. ..... 52/202; 52/398; 52/397; 52/766

[58] Field of Search ..... 52/202, 397, 398, 766, 52/203, 764

[56] References Cited

U.S. PATENT DOCUMENTS

| | | | |
|---|---|---|---|
| 2,113,613 | 4/1938 | Daemicke | 52/398 |
| 2,226,254 | 12/1940 | Owen | 52/202 |
| 2,848,762 | 8/1958 | Peterson | 52/202 X |
| 4,121,394 | 10/1978 | Brooks | 52/203 |
| 4,418,506 | 12/1983 | Weber et al. | 52/398 X |
| 4,472,914 | 9/1984 | DeBoef et al. | 52/202 |
| 4,625,479 | 12/1986 | Giguere | 52/203 X |

FOREIGN PATENT DOCUMENTS

| | | | |
|---|---|---|---|
| 478734 | 11/1951 | Canada | 52/202 |
| 2903464 | 8/1980 | Fed. Rep. of Germany | 52/398 |
| 1485457 | 5/1967 | France | 52/398 |

*Primary Examiner*—David A. Scherbel
*Assistant Examiner*—Lan Mai
*Attorney, Agent, or Firm*—Joseph Januszkiewicz

[57] ABSTRACT

A window structure using a retainer means for converting a single window pane into a double insulated window. Sealant tape is applied to the inside periphery of the primary window pane and then a secondary window pane is placed into abutting contact with the sealant tape. A U-shaped retainer with a gasket secured to one side thereof is moved into contact with the window pane and then secured to the window frame. A wedge is the moved into locking engagement with the retainer which exerts a constant compressive force onto the gasket and then onto the secondary window and sealant tape for the full length of the window pane. A trim member is then latched to the retainer by having its two longitudinally extending leg members locking onto spaced latch means on the retainer presenting an aesthetic appearance.

6 Claims, 4 Drawing Sheets

WINDOW MOLDING

BACKGROUND OF THE INVENTION

This present invention relates to the retrofitting of a single glazing or window pane to improve the insulation feature thereof and more particularly to a novel molding unit that seals and exerts a constant pressure along the full length of the added window pane or glazing while providing an aesthetic appearance.

In the construction of commercial buildings as well as residential homes it has become increasingly important to conserve energy by improving the insulation of the building's windows due to the increased cost of heating and cooling. Heretofore the energy costs for heating and cooling were not that significant. Particularly in the case of single window panes or glazings there was no real impetus to employ anything other than single windows. Accordingly, when the cost of heating and cooling increased, it became necessary to prove means for adding on a second window pane or glazing to an existing window pane to improve its insulation characteristics. The present invention is directed to the application of a second window pane to the inside of the original window and to provide a novel molding unit that exerts a predetermined force or pressure along the entire periphery of the second pane while providing a retainer means that present an aesthetic appearance along the full length and is consistent in its appearance along such full length. From the structural features of the molding unit, the predetermined force is built into the unit as it is installed, to permit its installation by workers that are not necessarily skilled in the art yet assures a highly acceptable installation with consistent results. The retainer's decorative unit allows easy access to the molding units installation that provides the compressive force on the secondary window pan.

SUMMARY OF THE INVENTION

The retrofitting of a window structure wherein the window frame receives a first window pane with a sealant tape mounted around and adhered to the peripheral interior thereof. A secondary window pane is mounted in abutting contact with the sealant tape. A retainer is fastened to the window frame and has one yieldable portion secured to a gasket for exerting a compressive force on the secondary window pane. Another portion of the retainer is rigid and defines a narrow channel with the one portion to receive a locking wedge that exerts such above compressive force. A trim member is latchable to the retainer to cover such retainer and present an aesthetic appearance. Alternatively, the retrofitting is also done where the glass is in place in an existing window frame and the tape is applied.

DETAILED DESCRIPTION

Figure 1:
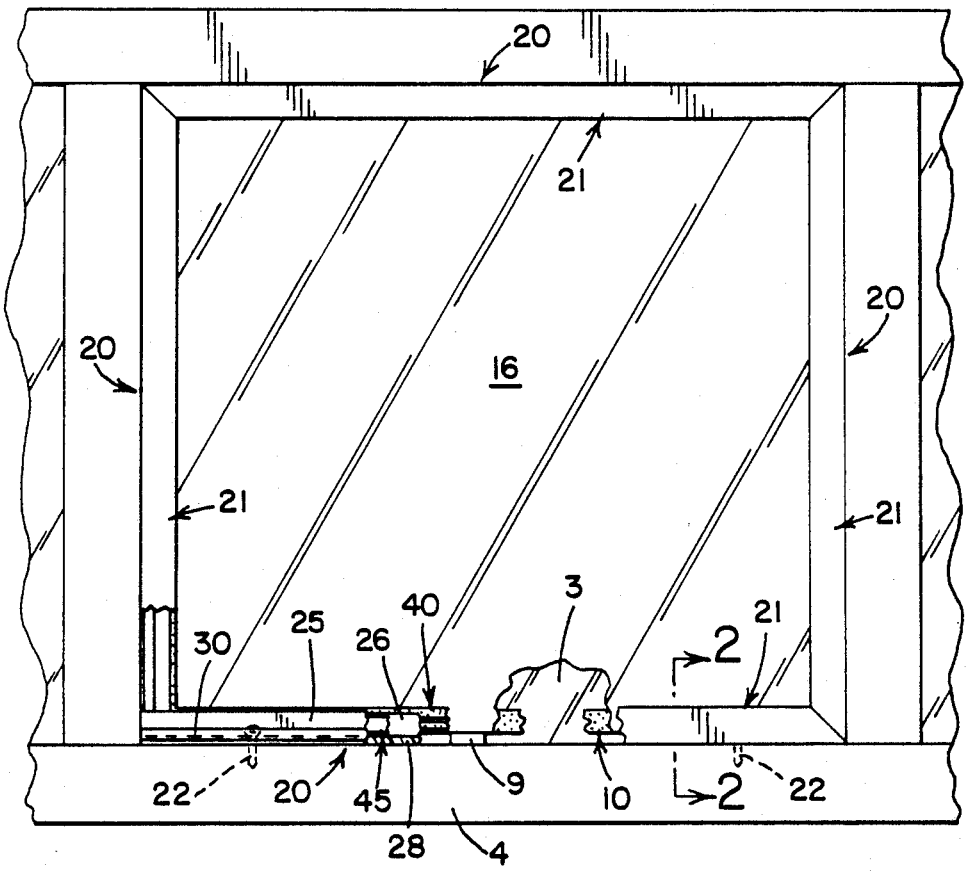
FIG. 1 is a front elevational view of a window pane installation with portions broken away to illustrate the components used in retrofitting a conventional window structure.
Figure 2:
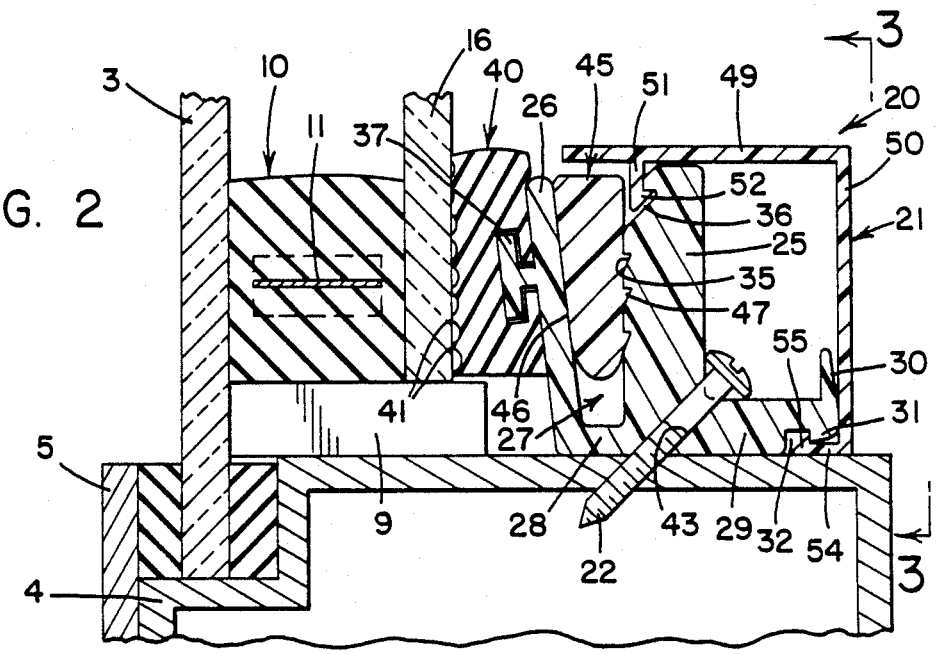
FIG. 2 is an enlarged cross sectional view taken on line 2—2 of FIG. 1 of the primary window pane and the secondary window pane and the retrofitting elements.

Referring now to the drawings, wherein like reference numerals designate like or corresponding parts throughout the several views, there is shown in FIG. 1 a conventional window structure which includes a primary window pane or glazing 3 mounted in a window frame or a permanent frame support 4 with the pane resting on the bottom portion of such frame with a trim piece 5 on the periphery of the window pane 3 to retain such pane 3 on the frame support 4. In lieu of the trim member 5, glazing may be substituted for such use.

Extending along the full peripheral length of the interior of the primary window pane 3 is a sealant deformable strip or tape 10 consisting of a generally rectangular shape (in cross section) and envelopes a spacer means 11 which extends longitudinally of the strip 10. The spacer means 11 is in the form of an undulating strip of a sine curve configuration of rigid material which may be aluminum. The sealant strip 10 because of its geometry resists compressive forces exerted on it in a plane that is normal to the longitudinally extending direction of the strip 10. It is to be noted that the strip 10 in its natural undeformed condition (FIG. 4) has two parallel sides 12 and 13 and two arcuate sides 14 and 15. The sealant strip would preferably include a desiccant which removes moisture from the air space that the sealant encloses. When sufficient pressure is applied to the sealant tape 10 by a window pane or glazing to be described, such arcuate sides 14 and 15 assume a linear shape. A spacer 9 is placed on the window sill of the frame support 4 to support the bottom portion of the tape 10 and the bottom edge of a secondary window pane 16 that is abutted against the sealant strip or tape 10. Such spacer 9 may be deleted and thus the tape 10 and the secondary window pane 16 would rest on the window sill; however, such spacer 9 is used to more easily install the cooperative elements of the secondary window pane 16.

Figure 3:
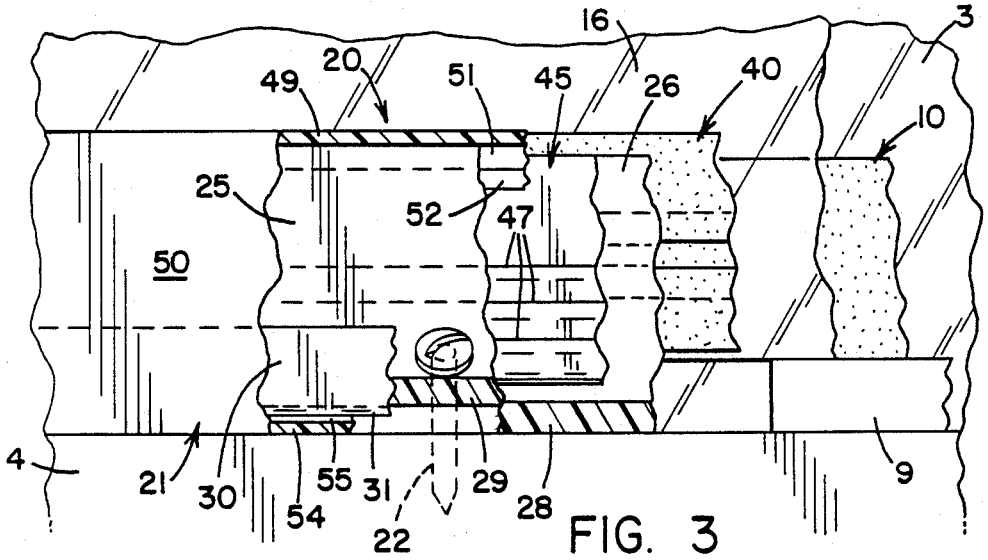
FIG. 3 is a fragmentary front elevational view taken on line 3—3 of FIG. 2 with portions of the retrofitting elements and the secondary window pane broken away.

Extending along the full peripheral length of the interior of the secondary window pane 16 is a retainer 20 which includes a trim member 21. As seen in FIG. 1, retainer 20 as applied to the window pane and the adjacent perimeter is composed of four lengths suitably mated at the respective corners. Only a portion of the retainer 20 will be described, which is shown in enlarged cross section in FIGS. 2–6. As shown in FIGS. 3 and 5, the retainer 20 is secured to the window frame 4 via screws 22.

Retainer 20 is a longitudinally extending U-shaped support member having a rigid longitudinally extending backing member 25 and a yieldable forwardly disposed longitudinally extending leg member 26 that is thin in cross section compared to backing member 25 to permit flexing. A channel 27 is defined between the backing member 25 and the leg member 26 along with a bridging portion 28 that interconnects such members 25 and 26. Extending rearwardly (as viewed in FIGS. 4 and 5) from the backing member 25 is an extension member 29 terminating into a flanged portion 30 that presents a downwardly extending tab 31 (FIG. 4) to define a longitudinal groove 32 between the tab 31 and very bottom of the extension member 29. The one surface of backing member 25 that forms part of the channel 27 has a plurality of small serrations 35. The uppermost edge portion of backing member 25 is reduced in cross section and has a larger serration 36 that is operative to provide a latching means to be described.

The longitudinally extending leg member 26 has a forwardly extending T-shaped projection 37 for securing a compression gasket 40 into engagement with the secondary window pane 16. The compression gasket 40 is formed of any suitable material capable of being compressed against the secondary window pane 16 for transferring compressive forces applied against it in a uniform manner. The compressive gasket 40 can be formed from a moderately pliable rubber or any gasket type material. Rubber is the preferred gasket material because condensation that may develop on the secondary window pane would not harm the gasket, nor support mold, or mildew growth. The gasket 40 includes a series of longitudinally extending ridges 41 on the one face that contacts the secondary window pane 16. Such series of ridges 41 aid in gripping the window pane 16 so that when compressive forces are applied against the compression gasket 40, such gasket 40 will not slide nor shift on the window pane 16. The other face of gasket 40 has a T-shaped groove formed therein to receive the T-shaped projection 37 of the longitudinally extending leg member 26. It is desirable to have the T-shaped projection 37 fairly broad to facilitate its secure connection to the gasket 40 while also insuring a broad based means for transferring compressive forces to the gasket 40 and the secondary window pane 16.

Figure 4:
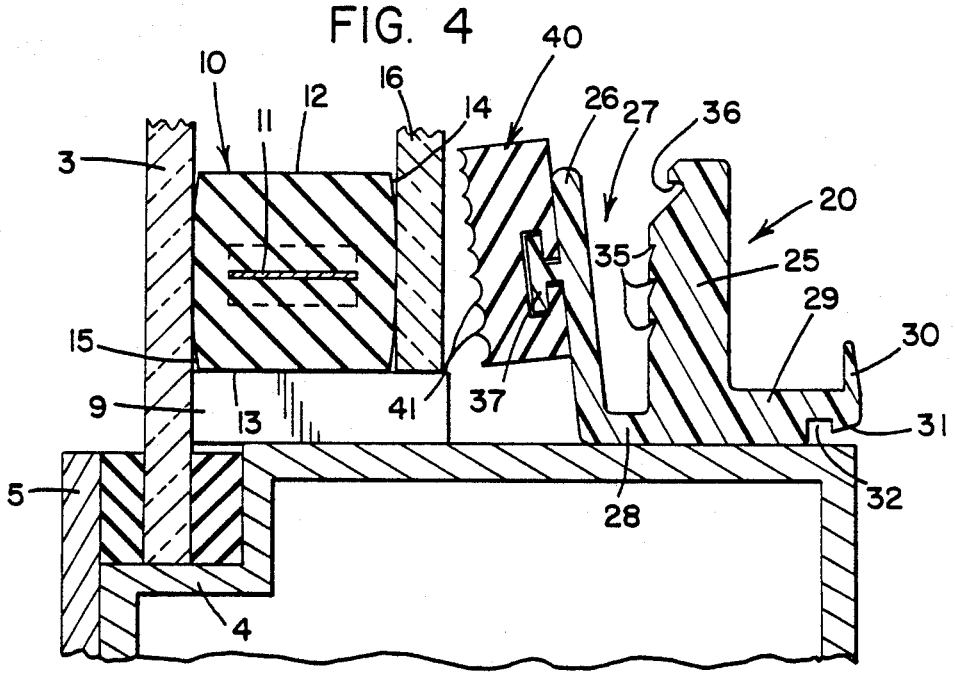
FIG. 4 is a cross sectional view of the primary window pane and the secondary window pane with a portion of the retrofitting element being slid into position for engagement with the secondary window pane.
Figure 5:
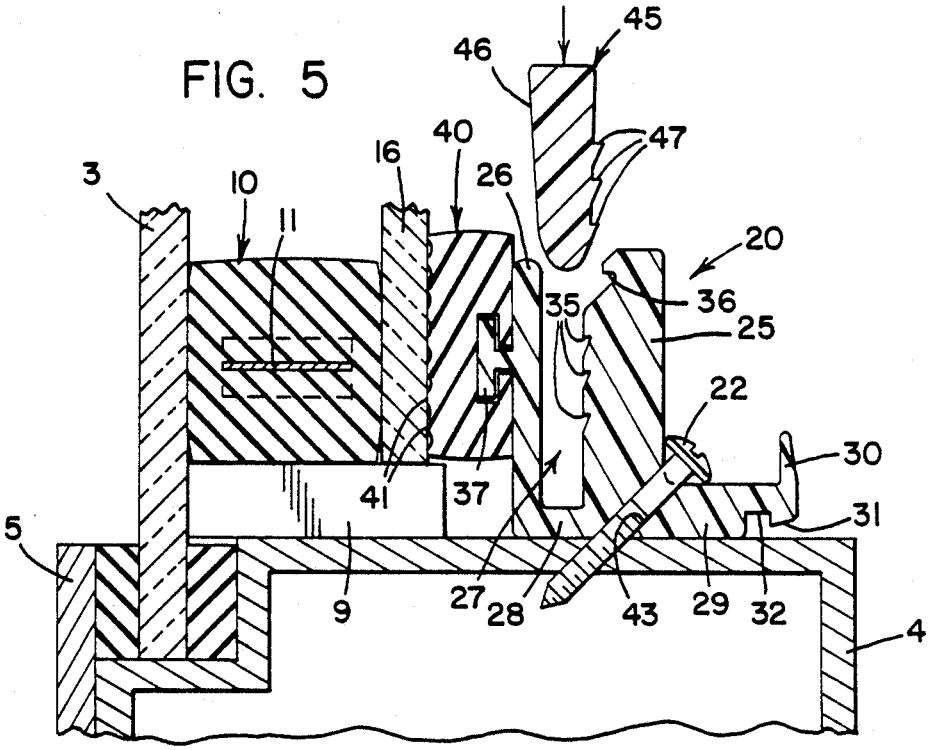
FIG. 5 is a cross sectional view of the primary window pane and the secondary window pane with a portion of the retrofitting element in engagement with the secondary window pane and a wedge latching means being introduced to such retrofitting element.
Figure 6:
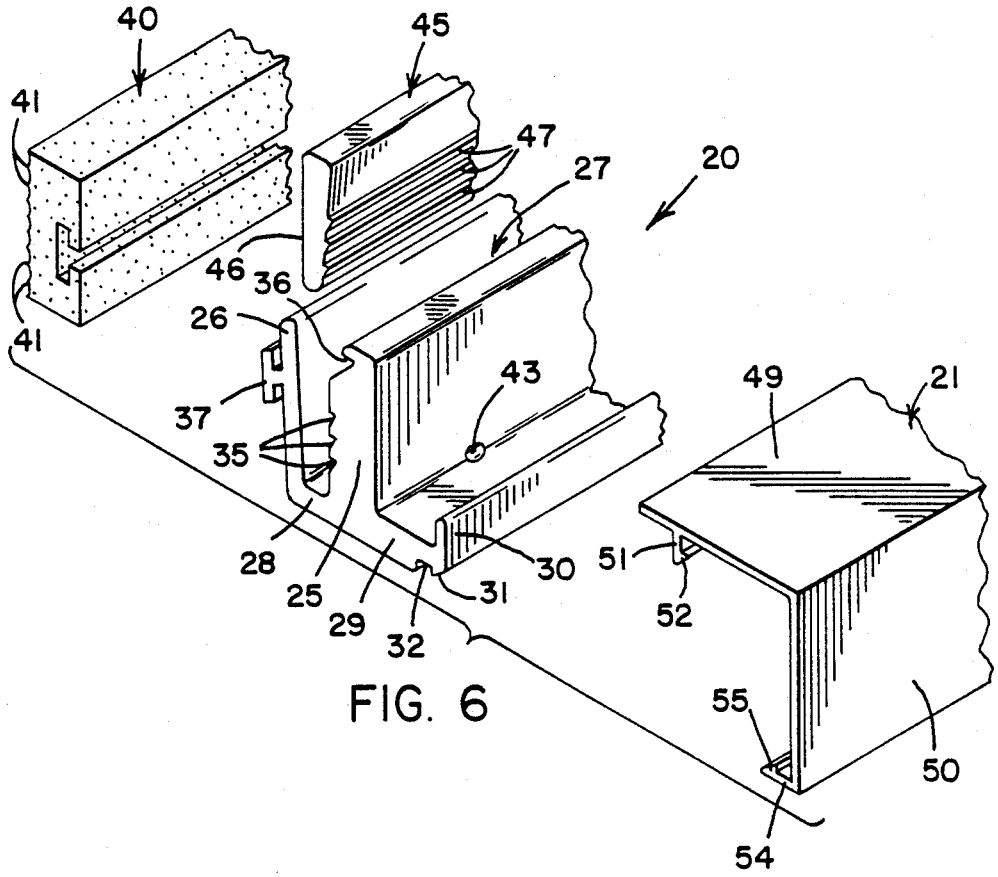
FIG. 6 is an enlarged, exploded perspective view of the retrofitting element.

The order to apply compressive forces against the gasket 40, retainer's leg member 26 is first connected to the gasket 40 as illustrated in FIG. 4 and the two elements (retainer 20 and gasket 40) are slid along the sill of the window frame until the gasket 40 abuts window pane 16 into the sealant deformable tape 10 as illustrated in FIG. 5. Thereafter a plurality of screws 22 are used to secure the retainer 20 in its position adjacent the periphery of the window pane 16. Predrilled holes 43 may be made into the retainer's 20 bridging portion 28 to facilitate the securing of such retainer on the window sill or window frame.

Figure 7:
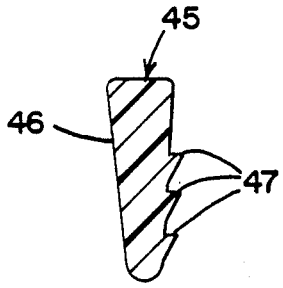
FIG. 7 is a cross sectional view of a locking wedge, smaller in dimension than that shown in FIG. 2.
Figure 8:
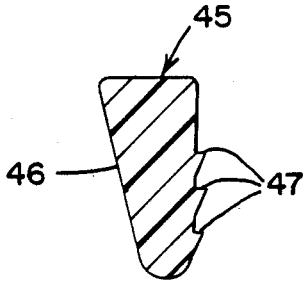
FIG. 8 is a cross sectional view of a locking wedge, larger in dimension than that shown in FIGS. 2 and 7.

A longitudinally extending locking wedge 45 that is elongated in cross section has one surface 46 that is smooth and an opposite face that has a plurality of serrations 47 that are cooperative with serrations 35 in channel 27 on rigid backing member 25 to lock the wedge 45 into channel 27 and exert a compressive force onto leg member 26 which in turn exerts a continuous constant pressure onto gasket 40 which in turn exerts a constant force onto window pane 16 and deformable tape 10. Thus with the backing member 25 of retainer 20 being rigid while leg member 26 being flexible, the introduction of locking wedge 45 into channel 27 is thus operative to deform leg member 26 and gasket 40. The amount of compressive force exerted onto the gasket 40, pane 16 and tape 10 can be determined by the location in which retainer 20 is secured to the frame support 4 by screws 22 and the thickness of the locking wedge 45. As seen in FIGS. 7 and 8 different cross sectional thickness of locking wedges are available for use to provide means for varying the force once the installation has been made.

After the retainer 20 is installed and the wedge 45 is locked into channel 27, a V-shaped trim member 21 with an upper leg member 49 and lower leg member 50 is latched onto the retainer 20. The upper leg member 49 has a longitudinally extending projection 51 depending from the one end thereof with a hook 52 extending inwardly therefrom for engagement with serration 36 on the backing member 25. The lower leg member 50 has a projection 54 at the very bottom thereof (as viewed in FIG. 2) with a hook 55 extending inwardly therefrom for engagement with the groove 32 on the flanged end portion of the retainer 20. With these members hooked or latched, the trim member 21 is securely fastened into its position and presents an aesthetic decorative trim or molding to the retrofitting of the window structure.

Various modifications are contemplated and may obviously be resorted to by those skilled in the art without departing from the described invention, as hereinafter define by the appended claims, as only a preferred embodiment thereof has been disclosed.

I claim:

1. A window structure comprising a rectangular window frame, a first pane seated and secured in said window frame, said first pane having an exterior surface and an interior surface, a sealant tape mounted around and adhered to the peripheral interior surface of said first pane, a secondary pane mounted on and into abutting contact with said tape, a retainer secured to said window frame adjacent to the entire periphery of said secondary window pane, said retainer having a forwardly disposed portion and a rearwardly disposed portion, said forwardly disposed portion lying closer to said window pane than said rearwardly disposed portion, said retainer having a plurality of spaced holes to receive securing means to fasten said retainer to said window frame, said forwardly disposed portion having a gasket secured thereto for abuttingly contacting with said secondary window pane, a channel separating said forwardly disposed portion from said rearwardly disposed portion, said rearwardly disposed portion being rigid, said forwardly disposed portion being yieldable in a direction away from rearwardly disposed portion, a wedge locking means received by said channel and cooperative with said rearwardly disposed portion for attachment thereto while operative to wedge said forwardly disposed portion with said gasket into compressive engagement with said secondary window pane, and a trim member attachable to and covering said retainer.

2. A window structure as set forth in claim 1 wherein said wedge locking means has a tapered configuration providing a compressive action on said gasket to bias said gasket as a compressive force on said secondary pane while directing a force toward the adjacent periphery of said secondary window pane.

3. A window structure as set forth in claim 2 wherein said rearwardly disposed rigid portion of said retainer having serrations facing said channel, and said wedge means has a plurality of serrations on one side surface that engages said serrations on said rearwardly disposed rigid portion of said retainer to lock said retainer into a compressive force on said secondary window pane.

4. A window structure as set forth in claim 3 wherein said forwardly disposed portion has a longtudinally extending flange member that is received by a groove in said gasket to integrally interconnect said retainer and said gasket.

5. A window structure as set forth in claim 4 wherein the upper edge of said rearwardly disposed portion of said retainer has an off-set serration, said rearwardly disposed portion has an extension with a second off-set seration, and said trim member has lock means for cooperative action with said off-set serrations to latch said trim member to said retainer.

6. A window structure as set forth in claim 5 wherein said flange member is T-shaped in cross section, and said groove in said gasket is T-shaped in cross section to complimentary receive said flange member in locking relationship.

* * * * *